US008469623B2

(12) United States Patent
Luyendijk et al.

(10) Patent No.: US 8,469,623 B2
(45) Date of Patent: Jun. 25, 2013

(54) QUICK COUPLING DEVICE

(75) Inventors: Dirk Jacobus Luyendijk, Heeswijk-Dinther (NL); Oswald Zaayman, Louisville, CO (US)

(73) Assignee: Caterpillar Work Tools B.V., S-Hertogenbosch (NL)

( * ) Notice: Subject to any disclaimer, the term of this patent is extended or adjusted under 35 U.S.C. 154(b) by 642 days.

(21) Appl. No.: 12/698,415

(22) Filed: Feb. 2, 2010

(65) Prior Publication Data

US 2010/0254755 A1 Oct. 7, 2010

Related U.S. Application Data

(60) Provisional application No. 61/165,537, filed on Apr. 1, 2009.

(51) Int. Cl.
*B25G 3/18* (2006.01)
*F16B 21/00* (2006.01)
*F16D 1/00* (2006.01)

(52) U.S. Cl.
USPC ..... 403/322.1; 403/322.3; 414/723; 37/468

(58) Field of Classification Search
USPC ..... 403/3, 4, 322.1, 322.3, 349, 350, 403/352, DIG. 4; 37/403–410, 468; 172/272, 172/273, 275; 414/723, 724
See application file for complete search history.

(56) References Cited

U.S. PATENT DOCUMENTS

| | | | | |
|---|---|---|---|---|
| 4,222,591 | A * | 9/1980 | Haley | 285/18 |
| 4,836,741 | A * | 6/1989 | St. Louis et al. | 414/723 |
| 5,394,630 | A | 3/1995 | Moinat | |
| 5,549,440 | A * | 8/1996 | Cholakon et al. | 414/723 |
| 5,692,325 | A | 12/1997 | Kuzutani | |
| 5,890,871 | A | 4/1999 | Woerman | |
| 6,074,120 | A | 6/2000 | Williams | |
| 6,158,950 | A * | 12/2000 | Wilt et al. | 414/723 |
| 6,302,611 | B1 | 10/2001 | de Gier et al. | |
| 6,350,079 | B1 * | 2/2002 | Williams | 403/326 |
| 6,533,529 | B2 | 3/2003 | Waggoner | |
| 6,659,708 | B2 * | 12/2003 | Heiple | 414/723 |
| 6,691,438 | B2 * | 2/2004 | Fatemi | 37/468 |
| 6,813,851 | B2 * | 11/2004 | Mieger et al. | 37/468 |
| 6,899,509 | B1 | 5/2005 | Mailleux | |
| 6,938,514 | B1 * | 9/2005 | Crane et al. | 74/571.1 |
| 7,246,457 | B2 * | 7/2007 | Mieger et al. | 37/468 |
| 7,473,067 | B2 * | 1/2009 | Nishioka et al. | 414/723 |
| 7,530,779 | B2 * | 5/2009 | Holloway et al. | 414/686 |
| 2002/0098032 | A1 | 7/2002 | Nye | |
| 2005/0214105 | A1 | 9/2005 | Steig, Jr. et al. | |
| 2007/0166143 | A1 | 7/2007 | Hart et al. | |
| 2007/0245603 | A1 | 10/2007 | Vering et al. | |
| 2008/0193210 | A1 * | 8/2008 | Beales | 403/326 |

FOREIGN PATENT DOCUMENTS

| | | |
|---|---|---|
| EP | 0 278 571 | 10/1990 |

* cited by examiner

*Primary Examiner* — Michael P Ferguson
*Assistant Examiner* — Nahid Amiri
(74) *Attorney, Agent, or Firm* — Liell & McNeil

(57) ABSTRACT

In one aspect of a coupling device for securing a primary mover to a work tool may include first and second coupling bodies interconnectable to form a first connecting interface and a second connecting interface spaced apart from the first connecting interface. The coupling device may also include a rotary wedge member attached to the first coupling body and rotatable to progressively force together the first and second coupling bodies.

7 Claims, 7 Drawing Sheets

QUICK COUPLING DEVICE

This Application Claims the Benefit of the Filing Date of U.S. Provisional Application Ser. No. 61/165,537, Filed Apr. 1, 2009.

TECHNICAL FIELD

This disclosure relates generally to a coupler, for example a quick coupler for coupling a work tool to a primary mover.

BACKGROUND

Quick couplers are commonly used for detachably connecting work tools, such as buckets, to primary movers, such as work arms of backhoes, excavators, or loaders. Quick couplers are advantageous because they may allow a machine operator to quickly change from one work tool to another. Thus, the use of a quick coupler may increase efficiency and versatility.

Many different types of couplers have been disclosed in the past. One coupler is disclosed in U.S. Pat. No. 6,158,950 entitled "Excavator Coupling", issued to Albert T. Wilt et al. on Dec. 12, 2000. The '950 patent discloses a coupler for attaching the articulating arm linkage of an excavator to a bucket or other work implement, "the coupler having a rotator carried between and rotatable relative to a pair of body parts. The rotator has an elongated channel for receiving a pin of the work implement and carries a crank, which may be manually turned or moved by a hydraulic cylinder to drive the rotator. In one position, the channel is open for permitting entry and removal of the pin and in other positions is closed to lock the pin from exiting. The coupler includes another pin receiving slot so that a second pin of the work implement may be received. The slot and the channel of the rotator in the open position are inclined relative to one another."

Another coupler is disclosed in U.S. Pat. No. 5,890,871 entitled "Latching Mechanism for a Quick Coupler", issued to Gary R. Woerman on Apr. 6, 1999. The '871 patent discloses a coupler for detachably coupling a work tool to the stick of an excavator or backhoe. "The quick coupler has a latching mechanism which is powered by a single acting cylinder to unlatch the coupler and which is powered by both a spring device and a gas charged accumulator to latch the coupler to the bucket."

A further coupler is disclosed in U.S. Pat. No. 5,692,325 entitled "Attachment Detaching Apparatus for Hydraulic Shovel", issued to Kazuteru Kuzutani on Dec. 2, 1997. The '325 patent discloses an attachment detaching apparatus for hydraulic shovels. The apparatus "includes a bracket pivoted, through an arm pin and a link pin, respectively, on a tip end of the arm of the hydraulic shovel. Guide grooves are provided with the opening portion being notched into the bracket. An oscillating arm where the opening portion has a notch located on the side opposite to the guide groove or the sliding slider is provided in a location opposite to the guide groove. An opening, closing apparatus for opening or closing the oscillating arm or the sliding slider is provided, the opening, closing apparatus is driven in the engaging direction by the engagement of a pin A of the attachment with the guide groove of the bracket and of a second pin B with the notch of the oscillating arm or the sliding slider so as to retain the attachment. A rotating hook, capable of grasping the pin A, is pivoted on the bracket through the rotating shaft. The rotating shaft is provided in a position where the rotating force in a direction of closing the rotating hook is applied when the pin A is operated in a direction along which the pin A is disengaged along the guide groove. The attachment detaching apparatus for hydraulic shovels has an opening, closing apparatus composed through the rotating hook, the oscillating arm or the sliding slider."

Yet another coupler is disclosed in U.S. Pat. No. 5,549,440 entitled "Fast-Make Coupler for Attaching a Work Implement to a Prime Mover", issued to Rifka Cholakon et al. on Aug. 27, 1996. The '440 patent discloses "An improved coupler assembly adapted for connecting a work implement to a prime mover. The main body portion of the coupler assembly has laterally spaced side plates, each of which includes first and second mounting-pin receiving slots having open mouths and apices. The mouths are adapted sequentially to receive first and second mounting pins secured to the work implement. The first slot is longer than the second slot, and the first slot incorporates a locating structure adapted to retain the first mounting pin within the mouths of the first slots before the second mounting pin is capable of being received within the mouths of the second slots. A locking sub-assembly having a rotator member extends laterally between the apices of the first slots. The rotator is mounted for rotation between a first and a second position. The rotator is adapted to engage the first mounting pin, when the rotator is in its first position, to retain the first mounting pin within the apices of the first slots. The rotator is also adapted, when in its second position, selectively to permit the first mounting pin to slide along the first slots after the second mounting pin is in substantial vertical alignment above the second slots."

While prior couplers may satisfactorily perform their intended tasks, improvements in the field are appreciated. For example, it may be desirable in the field to use a coupler that minimizes a separation distance between a work arm and a work tool coupled to the end thereof, so that leverage applied to the work tool by the work arm may be maximized and so that work tool efficiency may be improved. Moreover, it may be desirable in the field to use a coupler that is accommodating to wear between its various components. It may further be desirable to provide a coupler having relatively few parts.

The present disclosure is directed to various embodiments of an improved coupling apparatus.

SUMMARY OF THE DISCLOSURE

In one aspect of the present invention, a coupling device for securing a primary mover to a work tool may include first and second coupling bodies interconnectable to form a first connecting interface and a second connecting interface spaced apart from the first connecting interface. The coupling device may also include a rotary wedge member attached to the first coupling body and rotatable to progressively wedge together the first and second coupling bodies.

In another aspect of the present invention, a coupling device for securing a primary mover to a work tool may include a first coupling body having a relatively forward portion, a relatively rearward portion, a relative right side portion, and a relative left side portion. The first coupling body may be interconnectable with a second coupling body to form: (i) a first connecting interface having a first mating connection between the first and second coupling bodies at a first, relatively forward-right position on the first coupling body and a second mating connection between the first and second coupling bodies at a second, relatively forward-left position on the first coupling body, and (ii) a second connecting interface having a third mating connection between the first and second coupling bodies at a third, relatively rearward-right position on the first coupling body and a fourth mating connection between the first and second coupling bodies at a fourth, relatively rearward-left position on the first coupling body. The coupling device may also include a rotary wedge member connected to the first coupling body and rotatable to secure together the first and second coupling bodies. The rotary wedge member may be rotatable relative the first coupling body about an axis positioned relatively rearward of at least one of the third and fourth positions.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate exemplary embodiments or features of the invention and, together with the description, serve to explain principles of the invention. In the drawings.

Although the drawings depict exemplary embodiments or features of the present disclosure, the drawings are not necessarily to scale, and certain features may be exaggerated in order to better illustrate and explain the present disclosure. The exemplifications set out herein illustrate exemplary embodiments or features of the disclosure, and such exemplifications are not to be construed as limiting the scope of the invention in any manner.

DETAILED DESCRIPTION

Reference will now be made in detail to embodiments or features of the disclosure, examples of which are illustrated in the accompanying drawings. Generally, the same or corresponding reference numbers will be used throughout the drawings to refer to the same or corresponding parts.

Figure 1:
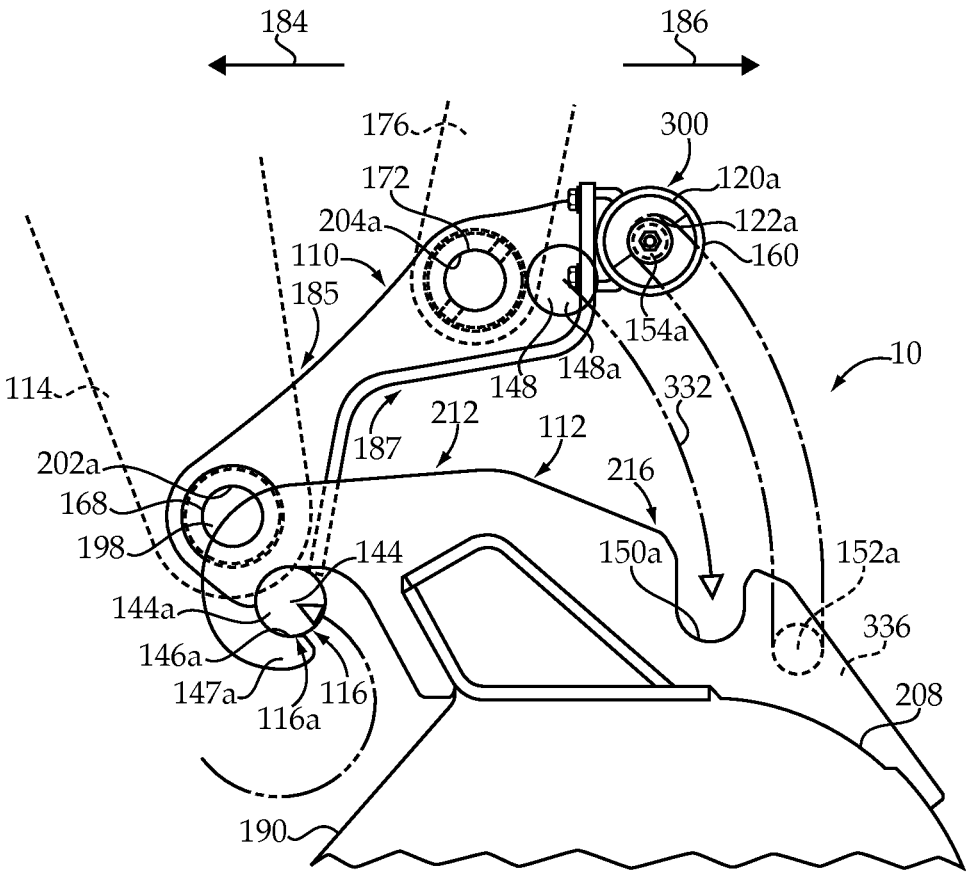
FIG. 1 is a partial diagrammatic side view of a coupler arrangement having first and second coupling bodies that are partially interconnected.
Figure 2:
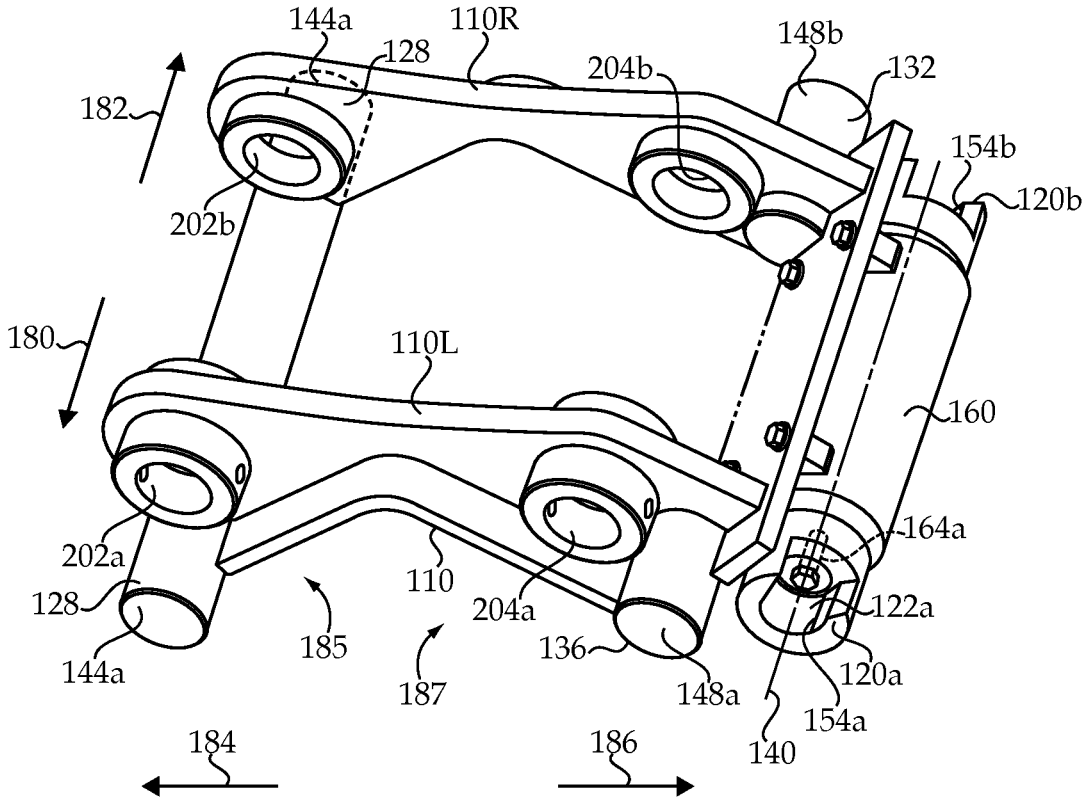
FIG. 2 is a partial diagrammatic perspective view of a coupling body of FIG. 1.
Figure 5:
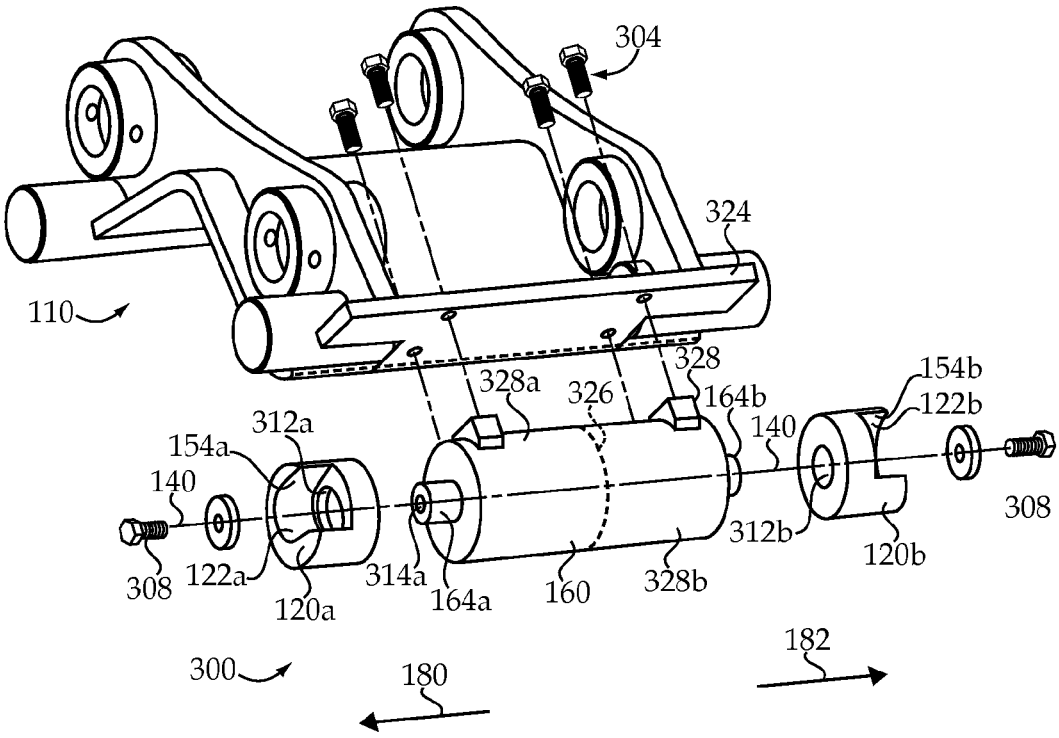
FIG. 5 is a partial diagrammatic perspective exploded view of a coupling body of FIG. 1.

Referring now to FIGS. 1, 2, 3, and 5, various relative directions are shown for explanatory purposes, such as a forward direction 184, a rearward direction 186, a left direction 180 (FIGS. 2 and 5), and a right direction 182 (FIGS. 2 and 5). As may be appreciated, the directions do not necessarily refer to the "front", "rear", "left side" or "right side" of a machine or tool, but are indicative of relative positions of components or features as described hereinbelow.

Referring now to FIG. 1, a coupler 10 for securing a primary mover 114 to a work tool 190 is disclosed. The coupler 10 may include a first coupling body 110 having first and second trunnion arrangements 144*a*, 148*a* and a rotary wedge arrangement 300, each adapted for interconnection with a second coupling body 112. The second coupling body 112 may have first and second slot arrangements 146*a*, 150*a* and a third trunnion arrangement 152*a*, each interconnectable with the first coupling body 110.

One of the coupling bodies 110 may be attached to a primary mover 114, for example so that the primary mover 114 may provide a motive force to the work tool 190 through the coupler 10. As shown in FIG. 1, the primary mover 114 may, for example, be a work arm 114 of an excavator, backhoe, loader, or the like. The coupling body 110 of FIG. 1 may be engaged to the work arm 114 at a forward portion 185 of the coupling body 110 via a first pinned connection 168. For example, a first pin 198 may be engaged with the coupling body 110 and the work arm 114 through a pair of forward openings 202—a left side forward opening 202*a* and a right side forward opening 202*b*—in the coupling body 110 and openings in the work arm 114 to hold the work arm 114 in working engagement with the coupling body 110.

The coupling body 110 may be engaged to a linkage 176 at a rearward portion 187 of the coupling body 110 via a second pinned connection 172. For example, a second pin 200 may be engaged through a pair of rearward openings 204—a left side rearward opening 204*a* and a right side rearward opening 204*b*—in the coupling body 110 and openings in the linkage 176 to hold the linkage 176 in working engagement with the coupling body 110. The linkage 172 may be attached to the arm work arm 114 and may further be attached to a hydraulic cylinder for applying an additional, selectively controlled working force to the work tool 190 through the coupler 10.

A first trunnion arrangement 144 (144*a*, 144*b*) may be incorporated with the coupling body 110 at a relative forward portion 185 of the coupling body 110. For example, in one embodiment a forward pin 194 may be connected, for example via a welded connection, to the forward portion 185 of the coupling body 110 so that a left portion of the pin 144*a* and a right portion of the pin 144*b* may form a first forward left trunnion member 144*a* and a second forward right trunnion member 144*b*, respectively.

A second trunnion arrangement 148 (148*a*, 148*b*) may be incorporated with the coupling body 110 at a relative rearward portion 187 of the coupling body 110 and spaced a first distance D1 (see FIG. 3) away from the first trunnion arrangement 144*a*, 144*b*. For example, in one embodiment rearward pins 148*a*, 148*b* may be connected, for example via welded connection, to the rearward portion 187 of the coupling body 110 so that a rearward left pin 148*a* and a rearward right pin 148*b* may form a first rearward left trunnion member 148*a* and a second rearward right trunnion member 148*b*, respectively.

The other of the coupling bodies 112 may be attached to the work tool 190, for example via a welded connection 208 (see FIG. 1).

A first slot arrangement 146 (146*a*, 146*b*) may be incorporated with the second coupling body 112 at a relative forward portion 212 of the coupling body 112. For example, in one embodiment a pair of forward slots 146*a*, 146*b* may be formed in the forward portion 212 of the coupling body 112 to form a first forward left slot 146*a* and a second forward right slot 146*b*, respectively. The forward left slot 146*a* and forward right slot 146*b* may be configured to receive the first forward left trunnion member 144*a* and the second forward right trunnion member 144*b*, respectively. In the embodiment shown in FIG. 1, the slots 146*a*, 146*b* are formed within hooks 147*a*, 147*b*, which curve rearward.

A second slot arrangement 150 (150*a*, 150*b*) may be incorporated with the coupling body 112 at a relative rearward portion 216 of the coupling body 112. For example, in one embodiment a pair of rearward slots 150*a*, 150*b* may be formed in the rearward portion 216 of the coupling body 112 to form a first rearward left slot 150*a* and a second rearward right slot 150*b*, respectively. The rearward left slot 150*a* and rearward right slot 150*b* may be configured to receive the first rearward left trunnion member 148*a* and the second rearward right trunnion member 148*b*, respectively.

Figure 7:
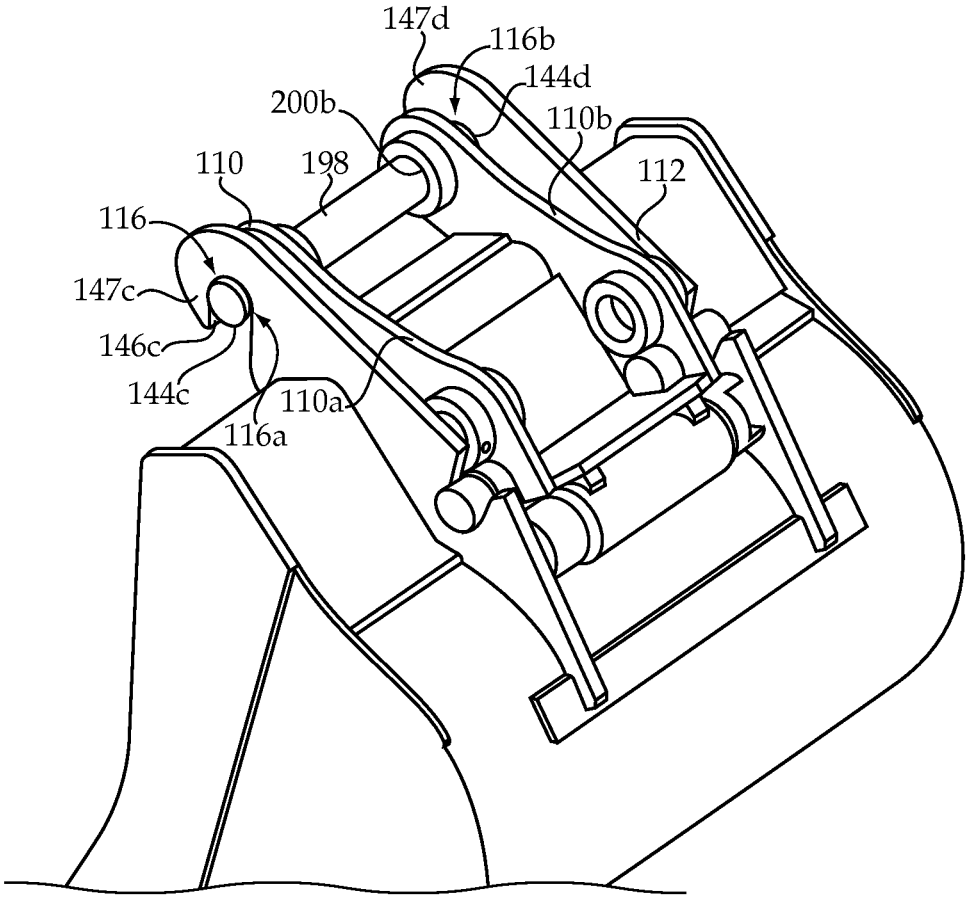
FIG. 7 is a partial diagrammatic perspective view of an alternative coupler arrangement.

Referring to FIG. 7, in an alternative embodiment, the first trunnion arrangement 144*a*, 144*b* may be formed from a pin 198 that secures the primary mover 114 to the first coupling body 110. In such an embodiment, the pin 198 forms part of the coupling body 110 and may be connected thereto via, for example, first and second openings 200*b* formed respectively in a forward left portion and a forward right portion of the first coupling body 110. The pin 198 may be attached to and held with the coupling body 110 so that ends of the pin 198 extend beyond each of the left side 110*a* and the right side 110*b* of the first coupling body 110 to form a first forward left trunnion member 144*c* of the first coupling body 110 and a second forward right trunnion member 144*d* of the first coupling body 110, respectively. In such an alternative embodiment, the second coupling body 112 may also be modified so that the first slot arrangement 146*c*, 146*d* is formed within hooks 147*c*, 147*d*, which curve downward.

Figure 3:
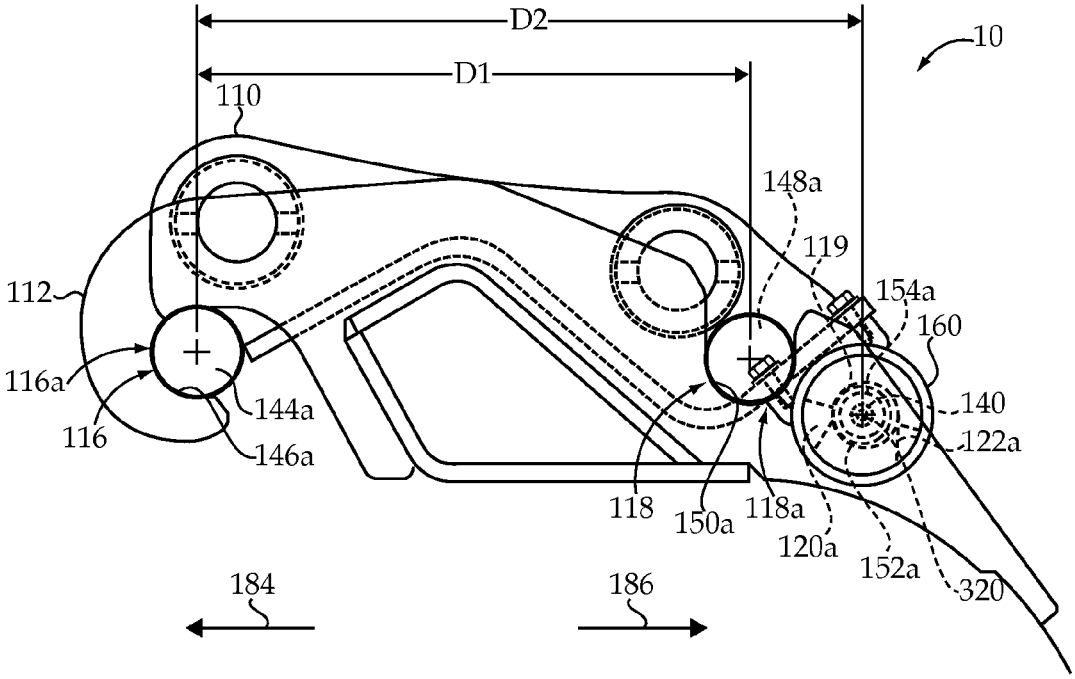
FIG. 3 is a partial diagrammatic side view of the coupler arrangement of FIG. 1, wherein the first and second coupling bodies are further interconnected.
Figure 4:
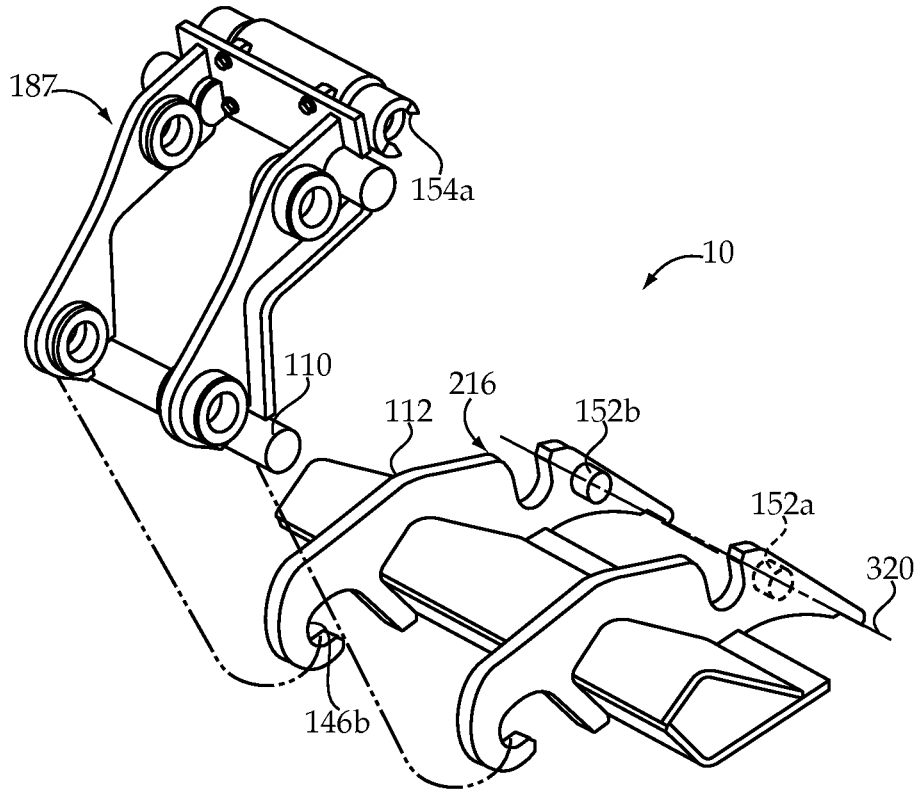
FIG. 4 is a partial diagrammatic perspective view of the coupler arrangement of FIG. 1, wherein the first and second coupling bodies are not interconnected.

Referring now to FIGS. 1 and 4, a third trunnion arrangement 152 (152*a*, 152*b*) may be incorporated with the coupling body 112 at a rearward portion 216 of the coupling body 112 and spaced a second distance D2 (see FIG. 3), which is greater than the first distance D1, away from the first trunnion arrangement 144*a*, 144*b* and the slot arrangement 146*a*, 146*b*. For example, in one embodiment a pair of rearward bosses 152*a*, 152*b* may be arranged, for example via a welded connection, to the rearward potion 216 of the coupling body 112 so that a rearward left boss 152*a* and a rearward right boss 152*b* may form a first rearward left trunnion member 152*a* and a second rearward right trunnion member 152*b*, respectively, and may be configured for engagement with a third slot arrangement including a first rearward left slot 154*a* and a fourth rearward right slot 154*b* on the respective rearward left and rearward right wedge members 120A, 120B.

As referenced above, a wedge arrangement 300 may be incorporated with the first coupling body 110, for example at a rearward portion 187 of the coupling body 110, and configured for engagement with the second coupling body 112.

In one embodiment, the wedge arrangement 300 may include a first rotary wedge member 120A at a relative left rearward portion of the coupling body 110 and a second rotary wedge member 120B at a relative right rearward portion of the coupling body 110.

The rotary wedge members 120A, 120B may be mounted to the first coupling body 110 via a rotary actuator 160 having first and second rotary output shaft members 164*a*, 164*b* extending outwardly therefrom along an axis 140. As seen in FIG. 3, the axis 140 may be generally aligned with a central axis 320 of the trunnion members 152*a*, 152*b* so that, similar to the trunnion members 152A, 152B, the rotary wedge members are mounted a distance D2 from the first trunnion arrangement 144. Further, the rotary actuator 160 may be positioned generally collinearly between the two wedge members 120A, 120B, for example generally along the axis 140. Thus, in one embodiment, the wedge members 120A, 120B are positioned rearward of the second trunnion arrangement 148*a*, 148*b* and are positioned to rotate about an axis 140 positioned rearward of the second trunnion arrangement 148*a*, 148*b*.

The rotary actuator 160 may be incorporated with the first coupling body 110, for example via mounts bolts 304 (FIG. 5) extending through a rearwardly positioned plate 324 of the first coupling body 110 and through mounting brackets 328 affixed with the rotary actuator 160. In one embodiment the rotary actuator 160 may be a hydraulic rotary actuator configured to rotate the rotary output shaft members 164*a*, 164*b* upon application of a hydraulic pressure by a hydraulic supply (not shown).

The rotary wedge members 120A, 120B may each be connected to a respective rotary output shaft member 164*a*, 164*b*, for example via a bolt member 308 connected through a respective wedge opening 312*a*, 312*b* and engaging threads arranged within a threaded orifice 314*a*, 314*b* of a respective output shaft member 164*a*, 164*b*. Thus, the rotary wedge members 120A, 120B may be selectively rotated, in tandem with the rotary output shaft members 164*a*, 164*b*, relative the first coupling body 110 and about the axis 140, for example upon application of a hydraulic pressure to the hydraulic actuator 160.

As indicated symbolically by line 326 in FIG. 5, in an alternative embodiment, the rotary hydraulic actuator 160 may be replaced by multiple (e.g., two) independent rotary hydraulic actuators having independently operable and controllable rotary output shafts 164*a*, 164*b*. Thus, a first rotary hydraulic actuator 328*a* may be connected to a first wedge member 120A via the first shaft 164*a*, and a second rotary hydraulic actuator 328*b* may be connected to a second wedge member 120B via the second shaft 164*b* independent of hydraulic actuator 328*a*. In such an embodiment, the first and second actuators 328*a*, 328*b* may each be operated independently of each other, for example via separate hydraulic lines (not shown), to independently drive the first and second output shafts 164*a*, 164*b* and the first and second wedge members 120A, 120B. The wedge members 120A, 120B may be operated to tighten together the first and second coupling bodies 110, 112 while accommodating for wear of one or more components of the coupler arrangement 10. Thus, by using two separate actuators 328*a*, 328*b* to independently operate the first wedge member 120A and the second wedge member 120B, further independent accommodation may be made for wear on a left side component or a right side component.

Referring now to FIGS. 1 and 5, each rotary wedge member 120A, 120B may be configured with a slot 154*a*, 154*b* within the respective rotary wedge member 120A, 120B. The slots 154*a*, 154*b* may be configured to interconnect with the second coupling body 112 by receiving therein the trunnion members 152*a*, 152*b* of the third trunnion arrangement 152*a*, 152*b* of the second coupling body 112, thus forming a third connecting interface 119 (FIG. 3) between the slots 154*a*, 154*b* of the first coupling body 110 and the trunnion members 152*a*, 152*b* of the second coupling body 112.

Figure 6B:
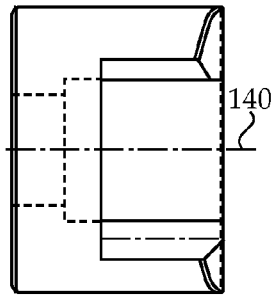
FIG. 6B is a first side view of a wedge member of FIG. 1.
Figure 6:
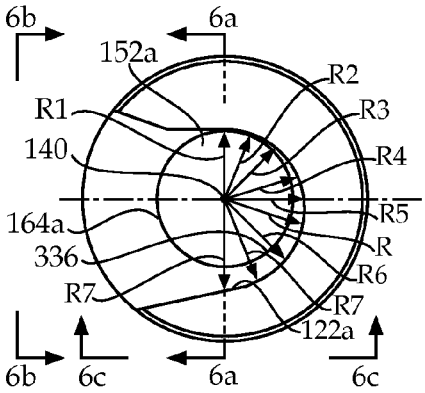
FIG. 6 is a view of a wedge member of FIG. 1.
Figure 6A:
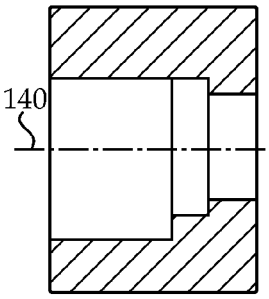
FIG. 6A is a sectioned view taken along line 6A-6A of FIG. 6.
Figure 6C:
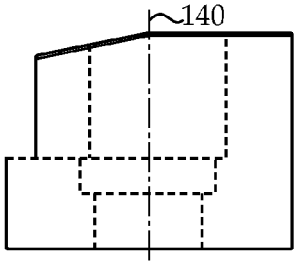
FIG. 6C is a second side view of a wedge member of FIG. 1.

Each rotary wedge member 120A, 120B may be formed with an arcuate wedge surface 122*a*, 122*b* configured to, upon progressive rotation of the rotary wedge member 120A, 120B, apply a progressively increasing tightening pressure to the trunnion arrangement 152*a*, 152*b* for tightening and securing together the coupling bodies 110, 112. For example, referring to FIG. 6, when a rotary wedge member 120A is in a first fixed angular position relative the first coupling body 110, the arcuate wedge surface 122*a* may be positioned about the axis 140 in a generally spiraling relationship such that the arcuate wedge surface 122*a* at least partially surrounds the axis 140 at radial positions R progressively further from the axis 140. As shown in FIG. 6, a radius R of an arcuate wedge surface 122*a* may have a first value R1 at a position approximating 12 o'clock, and the radius R value may gradually increase following the arcuate wedge surface 122*a* in a clockwise direction through 90 degrees toward the 3 o'clock position, and may further gradually increase following the arcuate wedge surface 122*a* in a clockwise direction another 90 degrees toward the 6 o'clock position.

The wedge members 120A in FIGS. 1 and 3 are illustrated in generally "open" positions, ready for initial assembling engagement with the trunnion member 152*a* of the second coupling body 112. The wedge member 120A shown in FIG. 6, however, is illustrated in a partially "closed" position having already been positioned into engagement with the trunnion member 152*a* and rotated in the clockwise direction slightly less than 90 degrees. In one embodiment, in a fully closed position the wedge member 120A of FIG. 6 may be rotated in the clockwise direction approximately 220 degrees from a starting, open position for fully locked engagement with the trunnion member 152*a*, so that a tightening pressure exerted by the arcuate wedge surface 122*a* may be applied to the trunnion member 152*a* in the vicinity of the position 336 indicated symbolically in FIGS. 1 and 6 (e.g., approximating a 4 or 5 o'clock position). The arcuate wedge surface 122*a* of the wedge member 120A may thus be configured so that further rotation of the wedge member 120A would further increase a tightening pressure on the trunnion member 152*a*. Thus, the wedge member 120A may be configured to permit further tightening, via rotation thereof, if needed, for example to accommodate for wear of the various coupling components, such as wear of the trunnion member 152, wear of the wedge arrangement 300, wear of the pins 148 or 144, or wear of the slots 150 or 146.

Referring again to FIG. 6, in one exemplary embodiment, the arcuate wedge surface 122*a*, while in a fixed position, may have a first radius R1, as measured from the axis of rotation 140, at a first position approximating 12 o'clock and may have a generally increasing radius R moving along the surface of the arcuate wedge surface 122*a* in the clockwise direction around the arcuate wedge surface 122*a* so that a radius R2 may increase at about a 2% amount over the first 22.5 degrees of rotation in a clockwise direction. For example, the radius R1 may be about 29 mm (1.14 in.), while the radius R2 may be about 29.6 mm (1.17 in.). The radius R may increase similarly (e.g., at a constantly increasing percentage) moving further clockwise around the arcuate wedge surface 122*a*. Alternatively, and as shown in FIG. 6, the radius R may increase by increasing percentages moving further clockwise along the surface of the arcuate wedge surface 122*a*, for example so that at a 3 o'clock position (90 degrees offset from the 12 o'clock position), the radius R4 would increase approximately 4.5% over the final 22.5 degrees preceeding the 3 o'clock position—i.e., the radius R4 of FIG. 6 would grow by 4.5% moving toward radius R5 of FIG. 6. In such an embodiment, the radius R of the arcuate wedge surface 122*a* may further increase, for example, by an amount of approximately 6% over the final 22.5 degrees toward the 6 o'clock position of FIG. 6—i.e., the radius R7 of FIG. 6 would grow by 6% moving toward radius R8 of FIG. 6. One effect of such a continuously increasing growth rate of the radius R moving clockwise around the surface of the arcuate wedge surface 122*a* is that as the wedge member 120A tightens around the trunnion member 152*a* in a clockwise position, further rotation of the wedge member 120A causes a progressively decreasing amount of tightening movement of the first coupling body 110 toward the second coupling body 112. Moreover, if a hydraulic actuator 160 is being controlled, for example by a hydraulic-pressure-controlled device, to tighten the coupling bodies together via the wedge arrangement 300 up to a specific desired tightening pressure, improved accuracy of reaching the desired tightening pressure may be obtained.

Industrial Applicability

Prior to assembling a first coupling body 110 to a second coupling body 112, the first coupling body 110 may be attached to a primary mover 114, for example via the pinned connections 168, 172; and the second coupling body 112 may be attached to a work took 190, for example via a welded connection 208 (see FIG. 1).

Referring to FIG. 1, during interconnection of the first coupling body 110 with the second coupling body 112, an operator may create a first connecting interface 116, (116*a*, 116*b* ) between the two bodies 110, 112 by positioning the first trunnion arrangement 144*a*, 144*b* of the first coupling body 110 into engagement with the first slot arrangement 146*a*, 146*b*. For example, the operator may create a first mating connection between the first and second coupling bodies 110, 112 via a first relatively forward-left trunnion member 144*a* and a first relatively forward-left slot 146*a*. The operator may create a second mating connection between the first and second coupling bodies 110, 112 via the second relatively forward-right trunnion member 144*b* and the second relatively forward-right slot 146*b*. It should be appreciated that the first and second mating connections may, at times, occur substantially simultaneously during an assembly operation.

The operator may then rotate the coupling body 110 about the first trunnion arrangement 144*a*, 144*b* in the direction of arrow 332 (FIG. 1) until the second trunnion arrangement 148*a*, 148*b* of the first coupling body 110 engages the second slot arrangement 150*a*, 150*b* of the second coupling body 112 to create a second connecting interface 118 (118*a*, 118*b*) (see FIG. 3). For example, the first rearward left trunnion member 148*a* may be brought into engagement with the first rearward left slot 150*a* of the second coupling body 112 to create a third mating connection between the first and second coupling bodies 110, 112; and the second rearward right trunnion member 148*b* may be brought into engagement with the second rearward right slot 150*b* of the second coupling body 112 to create a fourth mating connection between the first and second coupling bodies 110, 112.

A third interface 119 (FIG. 3) between the first coupling body and the second coupling body may also be created by the third slot arrangement 154*a*, 154*b* of the first coupling body 110 being brought into engagement with the third trunnion arrangement 152*a*, 152*b* of the second coupling body 112.

The hydraulic rotary actuator 160 may then be activated to cause (i) rotation of the rotary output shafts 164*a*, 164*b* about the axis 140 and (ii) rotation of the rotary wedge members 120A, 120B and the arcuate wedge surfaces 122*a*, 122*b* about the axis 140, to progressively tighten and secure together the first and second coupling bodies 110, 112.

As referenced above, the hydraulic actuator 160 may be controlled, either electronically or hydraulically for example, to tighten the wedge members 120A, 120B about the trunnion arrangement 152*a*, 152*b* until a predetermined tightening pressure is applied to tighten and secure together the coupling bodies 110, 112. Thus, the arcuate wedge surfaces 122*a*, 122*b* may cooperate to exert, upon progressive rotation of the rotary wedge members 120A, 120B about the axis 140, progressively increasing tightening pressure on the trunnion 152*a*, 152*b*, thereby urging the first and second coupling bodies together into progressively tighter engagement.

At least in part due to the relative spaced-apart (e.g., triangulated) positioning of the first trunnion arrangement 144*a*, 144*b*, the second trunnion arrangement 148*a*, 148*b*, and the third trunnion arrangement 152*a*, 152*b*, tightening of the third trunnion arrangement (e.g., via the wedge members 120A, 120B tightening about the third trunnion members 152*a*, 152*b*) may cause a simultaneous progressive tightening together of both (i) the first coupling body 110 and the second coupling body 112 at the first connecting interface 116 and (ii) the first coupling body 110 and the second coupling body 112 at the second connecting interface 118. Further, at least in part because the wedge arrangement 300 is spaced rearward of the first and second trunnion arrangements 144, 148 and engages the second coupling body 112 at a position rearward of the first and second trunnion arrangements, the securing and tightening elements of the rotary wedge arrangement 300 and the third trunnion arrangement 152 do not consume valuable space between the first and second coupling bodies and specifically between the first and second connecting interfaces 116, 118, so that the first and second coupling bodies 110, 112 (and therefore the work arm 114 and the work tool 190) may be positioned very close together.

As may be appreciated by the foregoing description, the arcuate wedge surfaces 122*a*, 122*b* of the rotary wedge members 120A, 120B are configured to engage the second coupling body 112 with a first pressure when the rotary wedge member is rotated into a first angular position relative the first coupling body 110 and to engage the second coupling body with a second, increased tightening pressure when the rotary wedge members 120A, 120B are rotated into a second angular position relative the first coupling body 110 (e.g., as described above when the wedge members 120A, 120B are rotated further about axis 140 into a fully locked position).

Even more specifically, in one embodiment, when the wedge members 120A, 120B are rotated about axis 140, from a first open position, approximately 160 degrees or beyond, into a first tightening position the arcuate wedge members 122*a*, 122*b* begin to tighten together the first and second coupling bodies by exerting a tightening pressure onto the third trunnion arrangement 152*a*, 152*b*. As the arcuate wedge members are further rotated, for example an additional 20 degrees (e.g., 180 degrees from the first open position) into a second tightening position the arcuate wedge surfaces 122*a*, 122*b* exert a greater tightening force upon the second coupling body 112 via the third trunnion arrangement 152, 152*b*. Similarly, as the arcuate wedge members are further rotated, for example an additional 20 degrees (e.g., 200 degrees from the first open position) into a third tightening position, the arcuate wedge surfaces 122*a*, 122*b* exert an even greater tightening force upon the second coupling body 112 via the third trunnion arrangement 152, 152*b*. Further, when the arcuate wedge members are further rotated, for example an additional 20 degrees (e.g., 220 degrees from the first open position) into a fourth tightening position, the arcuate wedge surfaces 122*a*, 122*b* exert an even greater tightening force upon the second coupling body 112 via the third trunnion arrangement 152, 152*b*.

From the foregoing it will be appreciated that, although specific embodiments of the invention have been described herein for purposes of illustration, various modifications may be made without deviating from the spirit or scope of the invention. Other embodiments of the invention will be apparent to those skilled in the art from consideration of the specification and figures and practice of the invention disclosed herein. It is intended that the specification and disclosed examples be considered as exemplary only, with a true scope and spirit of the invention being indicated by the following claims and their equivalents. Accordingly, the invention is not limited except as by the appended claims.

What is claimed is:

1. A coupling device for securing a primary mover to a work tool, comprising:

a first coupling body including a relative forward portion, a relative rearward portion, a relative right side portion, and a relative left side portion, the first coupling body being interconnectable with a second coupling body to form: (i) a first connecting interface having a first mating connection between the first and second coupling bodies at a first, relatively forward-left position on the first coupling body and a second mating connection between the first and second coupling bodies at a second, relatively forward-right position on the first coupling body, and (ii) a second connecting interface having a third mating connection between the first and second coupling bodies at a third, relatively rearward-left position on the first coupling body and a fourth mating connection between the first and second coupling bodies at a fourth, relatively rearward-right position on the first coupling body; and a rotary wedge member connected to the first coupling body and rotatable to secure together the first and second coupling bodies;

an actuator coupled with the rotary wedge member and operable to rotate the rotary wedge member relative the first coupling body about an axis positioned relatively rearward of at least one of the third and fourth positions, the rotary wedge member including a slot formed with a wedge surface therein configured to contact the second coupling body upon interconnecting the first and second coupling bodies, the wedge surface extending about the axis and defining a plurality of progressively smaller radiuses relative the axis at a plurality of progressive angular locations upon the wedge surface;

the first connecting interface comprises a first trunnion arrangement;

the second connecting interface comprises a second trunnion arrangement spaced a first distance apart from the first trunnion arrangement;

the rotary wedge member is interconnectable with the second coupling body to form a third connecting interface comprising a third trunnion arrangement spaced a second distance apart from the first trunnion arrangement and a third distance apart from the second trunnion arrangement, and the second distance is greater than the first distance; and the third trunnion arrangement is formed on the second coupling body and engagable with a third slot arrangement on the rotary wedge member.

2. The coupling device of claim 1, wherein:

the first trunnion arrangement is formed on the first coupling body and engagable with a first slot arrangement on the second coupling body; and the second trunnion arrangement is formed on the first coupling body and engagable with a second slot arrangement on the second coupling body.

3. The coupling device of claim 1, wherein the wedge surface includes an arcuate wedge surface configured to exert, upon progressive rotation of the rotary wedge member relative the first coupling body, progressively increasing tightening pressure on the second coupling body thereby urging the second coupling body into progressively tighter engagement toward the first coupling body.

4. A coupling device for securing a primary mover to a work tool, comprising:

a first coupling body including a relative forward portion, a relative rearward portion, a relative right side portion, and a relative left side portion, the first coupling body being interconnectable with a second coupling body to form: (i) a first connecting interface having a first mating connection between the first and second coupling bodies at a first, relatively forward-left position on the first coupling body and a second mating connection between the first and second coupling bodies at a second, relatively forward-right position on the first coupling body, and (ii) a second connecting interface having a third mating connection between the first and second coupling bodies at a third, relatively rearward-left position on the first coupling body and a fourth mating connection between the first and second coupling bodies at a fourth, relatively rearward-right position on the first coupling body; and a rotary wedge member connected to the first coupling body and rotatable to secure to ether the first and second coupling bodies the rotary wedge member being rotatable relative the first coupling body about an axis positioned relatively rearward of at least one of the third and fourth positions, the rotary wedge member including a slot formed with a wedge surface therein configured to contact the second coupling body upon interconnecting the first and second coupling bodies, the wedge surface extending about the axis and defining a plurality of progressively smaller radiuses relative the axis at a plurality of progressive angular locations upon the wedge surface;

the coupling device includes at least one rotary hydraulic actuator connected to the first coupling body and the rotary wedge member;

the rotary hydraulic actuator includes a rotary output shaft rotatable relative the first coupling upon application of hydraulic pressure to the rotary hydraulic actuator; and the rotary wedge member is connected to the rotary output shaft of the rotary hydraulic actuator so that the rotary wedge member rotates in tandem with the rotary output shaft.

5. The coupling device of claim 4, wherein:

the first connecting interface comprises a first trunnion arrangement;

the second connecting interface comprises a second trunnion arrangement spaced a first distance apart from the first trunnion arrangement; and the rotary hydraulic actuator is spaced a second distance apart from the first trunnion interface; and the second distance is greater than the first distance.

6. The coupling device of claim 4, wherein:

the rotary wedge member is a first rotary wedge member, and the coupling device further includes a second rotary wedge member connected to the rotary output shaft of the at least one rotary hydraulic actuator, and each of the rotary wedge members connected with the first coupling body and having a slot formed therein configured to receive the second coupling body and being operable via rotation by the at least one hydraulic actuator to engage the second coupling body within the corresponding slot; and the at least one hydraulic actuator is positioned colinearly between the two rotary wedge members.

7. The coupling device of claim 4, wherein:

the rotary wedge member includes a first rotary wedge member and a second rotary wedge member, both rotary wedge members connected with the first coupling body and operable to engage the second coupling body;

the coupling device includes a first rotary hydraulic actuator connected between the first coupling body and the first rotary wedge member;

the first rotary hydraulic actuator includes a first rotary output shaft rotatable upon application of hydraulic pressure to the first rotary hydraulic actuator;

the first rotary wedge member is connected to the first rotary output shaft of the first rotary hydraulic actuator so that the first rotary wedge member rotates in tandem with the first rotary output shaft;

the coupling device includes a second rotary hydraulic actuator connected between the first coupling body and the second rotary wedge member;

the second rotary hydraulic actuator includes a second rotary output shaft rotatable, independent of the first rotary output shaft, upon application of hydraulic pressure to the second rotary hydraulic actuator;

the second rotary wedge member is connected to the second rotary output shaft of the second rotary hydraulic actuator so that the second rotary wedge member rotates in tandem with the second rotary output shaft.

* * * * *